US010799043B2

(12) United States Patent
Quinter

(10) Patent No.: US 10,799,043 B2
(45) Date of Patent: Oct. 13, 2020

(54) FOOD SHIELD WITH ADJUSTABLE PANEL

(71) Applicant: Brass Smith Innovation, LLC, Wilmington, DE (US)

(72) Inventor: Geoffrey R. Quinter, Wilmington, DE (US)

(73) Assignee: BRASS SMITH INNOVATIONS, LLC, Wilmington, DE (US)

( * ) Notice: Subject to any disclaimer, the term of this patent is extended or adjusted under 35 U.S.C. 154(b) by 0 days.

(21) Appl. No.: 16/598,859

(22) Filed: Oct. 10, 2019

(65) Prior Publication Data

US 2020/0187679 A1 Jun. 18, 2020

Related U.S. Application Data

(63) Continuation-in-part of application No. 16/217,847, filed on Dec. 12, 2018.

(51) Int. Cl.
*A47F 10/06* (2006.01)

(52) U.S. Cl.
CPC ..... *A47F 10/06* (2013.01); *A47F 2010/065* (2013.01)

(58) Field of Classification Search
CPC .. A47F 3/005; A47F 3/007; A47F 3/12; A47F 10/06; A47F 2003/008; A47F 2010/065
USPC ..... 312/140.4
See application file for complete search history.

(56) References Cited

U.S. PATENT DOCUMENTS

| | | | | |
|---|---|---|---|---|
| 8,109,579 | B2 * | 2/2012 | English | A47B 96/062 312/137 |
| 8,308,249 | B2 * | 11/2012 | Matus, Jr. | A47F 3/007 312/137 |
| 9,010,883 | B2 | 4/2015 | Scott | |
| 9,339,131 | B1 | 5/2016 | Christianson | |
| 9,557,004 | B1 | 1/2017 | McGrath | |
| 9,723,935 | B1 * | 8/2017 | McAllister | A47F 10/06 |
| 2007/0236112 | A1 | 10/2007 | Williman | |
| 2011/0169384 | A1 | 7/2011 | Padden et al. | |
| 2016/0073795 | A1 * | 3/2016 | Matus, Jr. | A47F 10/06 312/137 |
| 2019/0110614 | A1 * | 4/2019 | Charlier | A47F 10/06 |
| 2020/0187678 | A1 | 6/2020 | Quinter et al. | |

OTHER PUBLICATIONS

U.S. Appl. No. 16/217,847 Non-Final Office Action dated Apr. 17, 2020, 20 pages.
U.S. Appl. No. 16/217,847 Non-Final Office Action dated Jun. 4, 2020, 22 pages.

* cited by examiner

*Primary Examiner* — Andrew M Roersma
(74) *Attorney, Agent, or Firm* — Adsero IP

(57) ABSTRACT

A food shield panel support providing for food shield panel position adjustment. The panel support includes a panel support arm connected to a panel support plate. The panel support plate defines a longitudinal slot. The system includes a tensioning apparatus extending through the longitudinal slot. The tensioning apparatus may be operated to permit the position of the panel support plate, and any attached panel, to be adjusted with respect to the panel support arm to any one of an infinite number of positions along the length of the slot. The tensioning apparatus may further be operated to secure the position of the panel support plate relative to the panel support arm.

16 Claims, 13 Drawing Sheets

FOOD SHIELD WITH ADJUSTABLE PANEL

RELATED APPLICATION

This application is a continuation in part of U.S. application Ser. No. 16/217,847, filed on Dec. 12, 2018, entitled "Food Shield with Adjustable Panel", which is incorporated herein by reference in its entirety.

FIELD OF THE INVENTION

The present disclosure relates to systems, apparatus and methods for implementing a food shield, and more particularly to systems, apparatus and methods for implementing a food shield with an adjustable panel.

BACKGROUND OF THE INVENTION

Food shields, also sometimes called sneeze guards, are used in a variety of settings. Typically, a food shield includes at least one transparent panel that is suspended over a buffet, smorgasbord, salad bar, retail display, or other kind of food display. The food shield serves to attractively display the food while protecting the food from falling debris or other contamination. Various health and safety codes may specify the required position of a food shield in relation to a commercial or institutional food display. Within the range of code-required food shield configurations however, it is desirable to implement a food shield in a manner that is attractive and consistent with the surrounding architecture. It can be difficult, using conventional food shield structures, to install a system which appears to be custom-made for the location.

Food shields are often used in restaurants, schools, cafeterias and other high-use settings. It can be necessary to regularly adjust the configuration or positioning of a food shield system as different food items are displayed over time, or even throughout the day. Adjustment and routine food shield maintenance can be difficult using known food shield structures because the assembly, disassembly, and adjustment of a food shield may require the time-consuming use of tools. The embodiments disclosed herein are directed toward overcoming one or more of the above problems.

SUMMARY

Various embodiments disclosed herein provide improved apparatus and methods for implementing a food shield. Certain disclosed embodiments provide apparatus for implementing a food shield with an adjustable panel. One representative example is a food shield having a panel defining a slot through the panel and a panel support. In this representative example, the panel support structure includes a panel clamp. A portion of the panel clamp may extend through the slot, and the slot provides for the panel to be moved relative to the panel clamp, along the length of the slot, from a first position to a second position. Thus, the panel clamp provides for the position of the panel relative to the panel clamp to be selectively adjusted, clamped into place, and released for movement along the length of the slot.

The panel clamp may include a cover plate having a cover plate width and a cover plate length, with the width and length sized to cover the entire slot in one or more positions. The panel clamp may also include a panel support arm in contact with a surface of the panel, opposite any cover plate. In some embodiments, the panel clamp also includes a clamping post connected to the cover plate and extending through the slot to the panel support arm, along with a tensioning apparatus connected to the clamping post opposite the cover plate. The tensioning apparatus is configured to move the cover plate toward the panel support arm to clamp the panel at a selected position, and/or move the cover plate away from the panel support arm to release the panel for movement along the length of the slot. In certain embodiments, the tensioning apparatus can be operated without the use of tools, for example, the tensioning apparatus may be implemented with a cam lever.

Another representative example is a food shield having a panel support arm connected to a panel support plate. The panel support plate defines a longitudinal slot. The system includes a tensioning apparatus extending through a longitudinal slot connecting the panel support plate to the panel support arm. The tensioning apparatus may be operated to permit the position of the panel support plate to be adjusted with respect to the panel support arm to any one of an infinite number of positions along the length of the slot. The tensioning apparatus may further be operated to secure the position of the panel support plate relative to the panel support arm. In this embodiment, a panel may be mounted to the panel support plate. Thus, when the position of the panel support plate is adjusted relative to the panel support arm, the position of the panel is adjusted as well.

The panel support of the food shield may also include a stand clamp, a pivoting connection extending from the stand clamp, and a panel support arm connected to the stand clamp with the pivoting connection. The pivoting connection can provide for an adjustment of an angular orientation of the support arm, and therefore any attached panel, relative to a stand. A representative pivoting connection includes a threaded shaft extending from the stand clamp, an opening extending through the panel support arm defining a pivot axis parallel to the lengthwise axis of the threaded shaft, an array of perimeter engagement slots extending at least partially through the panel support arm at the opening, and a tooth plate comprising a plurality of teeth sized to selectively engage and disengage with the perimeter engagement slots. In this embodiment, a pivot knob is threaded onto the threaded shaft, such that rotating the pivot knob in a first direction drives the plurality of teeth on the tooth plate into engagement with the array of perimeter engagement slots, and rotating the pivot knob in the opposite direction allows a spring or similar mechanism positioned around the threaded shaft to bias the tooth plate away from the stand clamp.

The stand clamp includes apparatus to tighten the clamp around a stand, pole, or similar structure. In one embodiment, the tightening apparatus includes first and second tapered threaded extensions extending from the clamp and a clamp knob threaded onto both of the tapered threaded extensions. The tapered threads of the extensions cause the first tapered threaded extension to move toward the second tapered threaded as the clamp knob is tightened.

Alternative embodiments include methods of adjusting or positioning one or more panels of a food shield within various planes and around selected axes using some or all of the panel clamp, pivoting connection, and stand clamp apparatus disclosed herein.

Various modifications and additions can be made to the embodiments discussed without departing from the scope of the invention. For example, while the embodiments described above refer to particular features, the scope of this invention also includes embodiments having different combination of features and embodiments that do not include all of the above described features.

DETAILED DESCRIPTION OF THE INVENTION

Figure 1A:
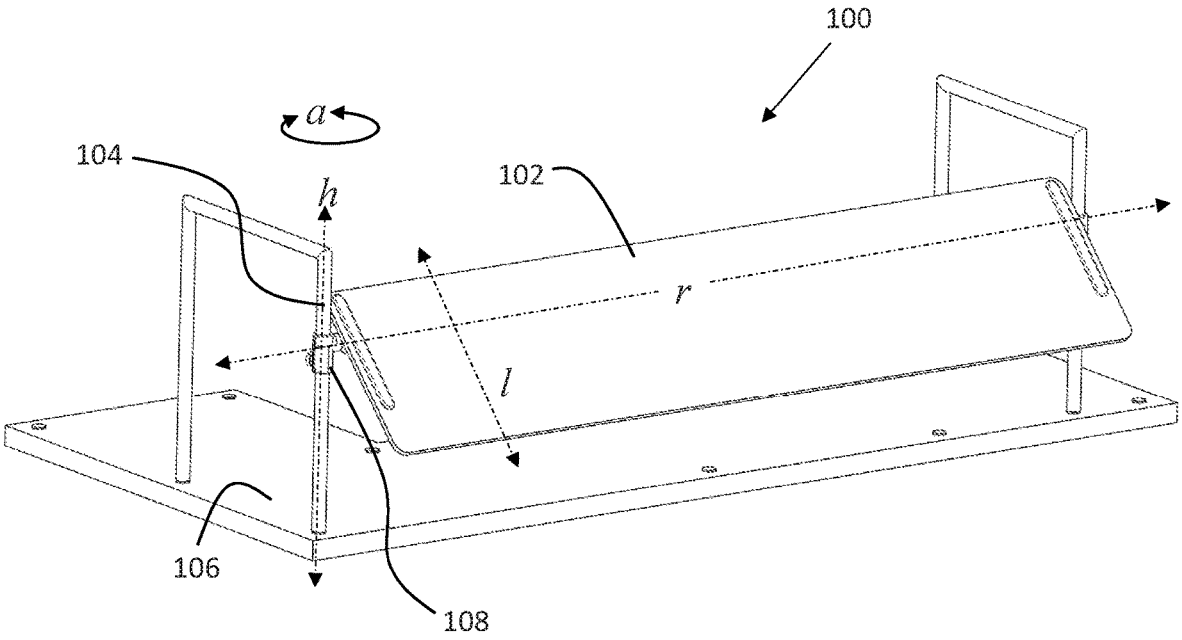
FIG. 1A is a perspective view of a food shield with an adjustable panel in a first position.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The embodiments disclosed herein provide a variety of food shields, also known as sneeze guards, having various features that permit the food shields to be used in a wide variety of settings. For example, the food shields may be provided with various adjustable features to permit a single food shield to be used in a variety of circumstances. Such adjustable features may include the ability to adjust the height, orientation, and/or depth of one or more food shield panels. Another feature of the food shields is that they may be configured to be either portable or secured to a certain location. Further, the food shields are simple in design, thereby making it easy to relocate or to securely couple the food shields to a surface. The simple design also lends itself to easy assembly and disassembly and facilitates cleaning of the food shield.

Another feature of the food shields is that they may be constructed to be easily integrated with other components. For example, a food shield may be modified to include one or more additional food shield panels. The food shields may also be linked together to form multiple food shields. A variety of bases may be provided to facilitate positioning of the food shield panels at certain desired locations. The bases may also be employed to facilitate attachment of the food shields to various mounting surfaces, such as counters, walls, ceilings, and the like. One particular advantage of utilizing multiple food shield panels that are each adjustable is that a variety of configurations may be produced.

Figure 1B:
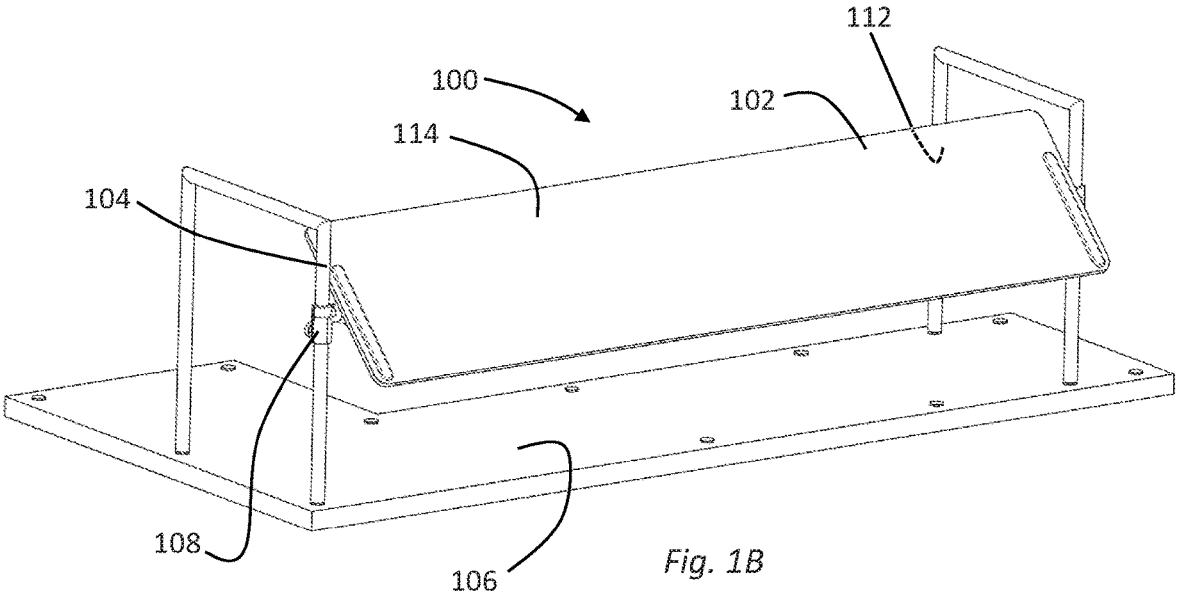
FIG. 1B is a perspective view of the food shield with an adjustable panel of FIG. 1A, in a second position.

FIGS. 1A and 1B (collectively, FIG. 1) show perspective views of one example of a food shield system 100 having a panel 102 supported by a stand 104 over a base 106. FIG. 1A illustrates the panel 102 in a first position, translated up and forward relative to the adjacent stands 104. FIG. 1B shows a view of the panel 102 in a second position, after the panel 102 has been translated down and backward relative to the adjacent stands 104.

The base 106 may be generally configured as a cabinet, table, bar, counter, or the like. The base 106 may include various configurations of trays, receptacles, openings, heating elements, cooling elements, or similar apparatus to permit the attractive and sanitary display of food items. The food shield system 100 may be used in a variety of settings, for example at a buffet, smorgasbord, salad bar, other kind of food display, other retail display, or the like. The food shield system 100 may be as large or complicated as required and can include multiple bases 106, multiple panels 102, and multiple stands 104 in any configuration. In use, the food shield system 100 protects food or other merchandise from falling debris or other contamination. The panels 102 are therefore typically clear or transparent to enable customers to view displayed food or other products. Representative panels 102 might be fabricated from glass, transparent acrylic, transparent polycarbonate, or similar materials.

A panel 102 is typically connected to at least one stand 104 with a panel support 108. As shown in FIG. 1, a pair of panel supports 108, attached to adjacent stands 104, can be configured to each hold opposing sides of a panel 102. In alternative configurations, one panel support 108 can be configured to hold one side of a panel 102 extending away from a single stand 104. Any combination of stands 104, panel supports 108, panels 102, and bases 106 is within the scope of this disclosure.

As detailed below, a panel support 108 can include various adjustment mechanisms or adjustment structures permitting a user to adjust and set the position or orientation of the attached panel 102. For example, as shown in FIG. 1A, a panel support 108 may include integrated structure(s) permitting a user to rotate a panel 102 about an axis "r"

parallel to the width of the panel, to set the angular orientation of the panel 102 as desired. In addition, a panel support 108 may include integrated structure(s), to permit a user to translate the position of the panel 102 along a line "1" within the plane of a panel 102. The panel support 108 may further include integrated structures to permit a user to adjust the height of the panel support 108 relative to a stand 104 along a line "h". This or another mechanism may also permit adjustment of the angular orientation of a panel 102 in either direction and to any desired extent around an axis defined by a stand 104, as indicated by axis of rotation "a" illustrated on FIG. 1A. Representative mechanisms providing adjustability to the position and orientation of a panel 102 are described below with respect to FIGS. 2-7.

Figure 2:
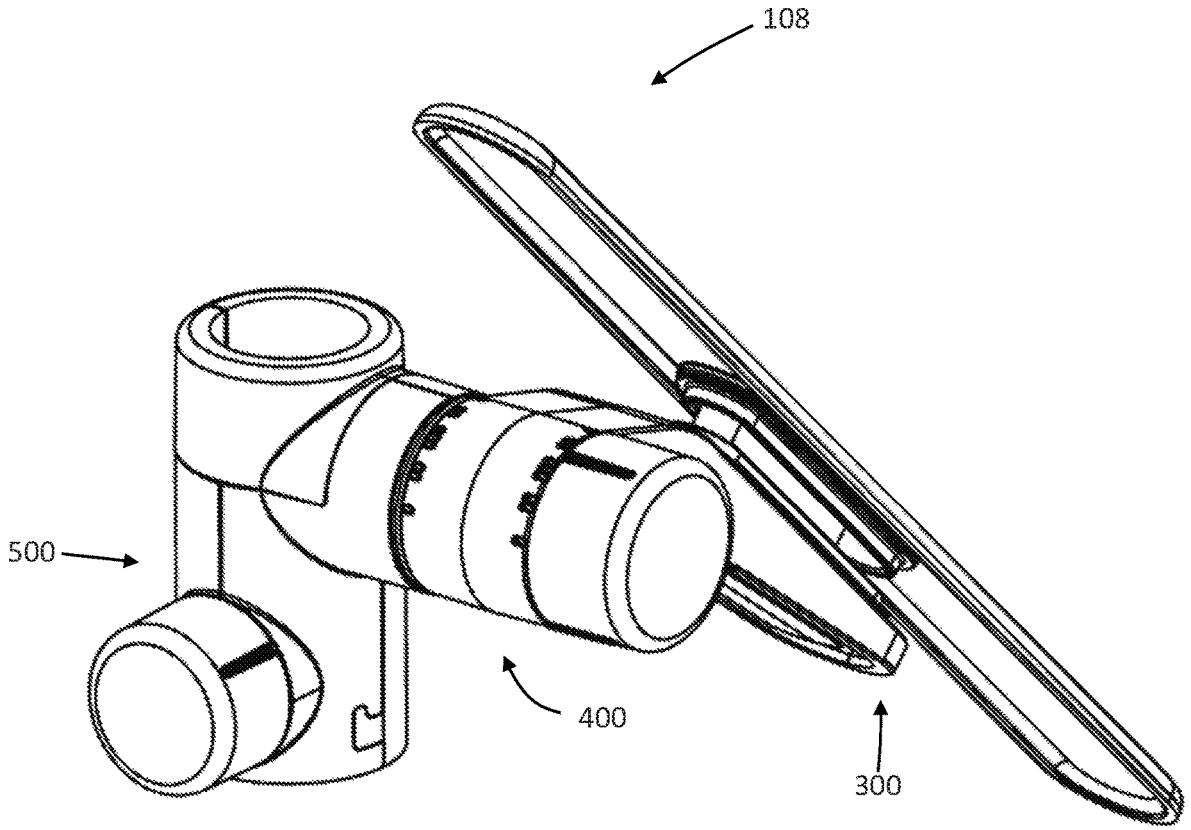
FIG. 2 is a rear perspective view of a panel support.

FIGS. 2 and 4-7 show a panel support 108 and various elements and subsystems of the panel support 108. Generally, as shown in FIG. 2, a panel support 108 might include a panel clamp assembly 300, a pivoting connection, 400, and a stand clamp assembly 500. As described in detail below, these subsystems provide for the adjustment of the position or orientation of a panel 102 relative to a stand 104 or base 106. Various embodiments of panel support 108 can include some, all, or any combination of the foregoing or other subsystems. Generally, in this description, the elements of the panel clamp assembly 300 will be identified with "300" series reference numerals. Similarly, the pivoting connection 400 elements will be identified with "400" series reference numerals, and elements of the stand clamp assembly 500 will be identified with a "500" series reference numerals. It is important to note however, that several elements of a panel support 108 might serve multiple purposes and may function within more than one subsystem.

The panel clamp assembly 300 clamps the panel 102 to a panel support 108, but also may be configured to enable the panel 102 to be selectively positioned and/or locked into a desired position along the line 1 as illustrated in FIG. 1A. Thus, the panel clamp assembly 300 may provide for the position of a panel 102 to be translated along a line parallel to the plane defined by the panel itself. Some embodiments may include curved panels which are translated within a plane, but the plane is not defined by the panel itself. In some embodiments, translation along line 1 may be movement along a line perpendicular to the panel width. In other embodiments, translation along the line 1 may be movement at an angle offset by any desired degree from perpendicular, but still parallel to a plane of movement.

The pivoting connection 400 can, in some embodiments, provide for the rotation of a panel 102 around axis r. Therefore, if a pivoting connection 400 is provided, it facilitates adjustment of the angular orientation of a panel 102 relative to a stand 104 or base 106. The stand clamp subsystem 500 serves to clamp or otherwise attach a panel support 108 to a stand 104, a post, or a similar structure. In some embodiments, the stand clamp 500 permits a panel support 108 (and any associated panel 102) to be positioned at a selected height along a line h relative to a stand 104. In some embodiments, as shown in FIG. 1A, the stand clamp assembly 500 may also permit variable adjustment of the angular orientation of a panel support 108 and panel 102 around an axis a defined by a stand 104. Although the figures illustrate a stand 104 having substantially straight and vertical side posts, is important to note that alternative embodiments of stand 104 could have curved or angled posts, arms, sides, panels, or other structures which define similar, but different adjustment lines, curves or angles. In certain embodiments some or all the various positional adjustments described herein may be accomplished without the use of tools.

Figure 3:
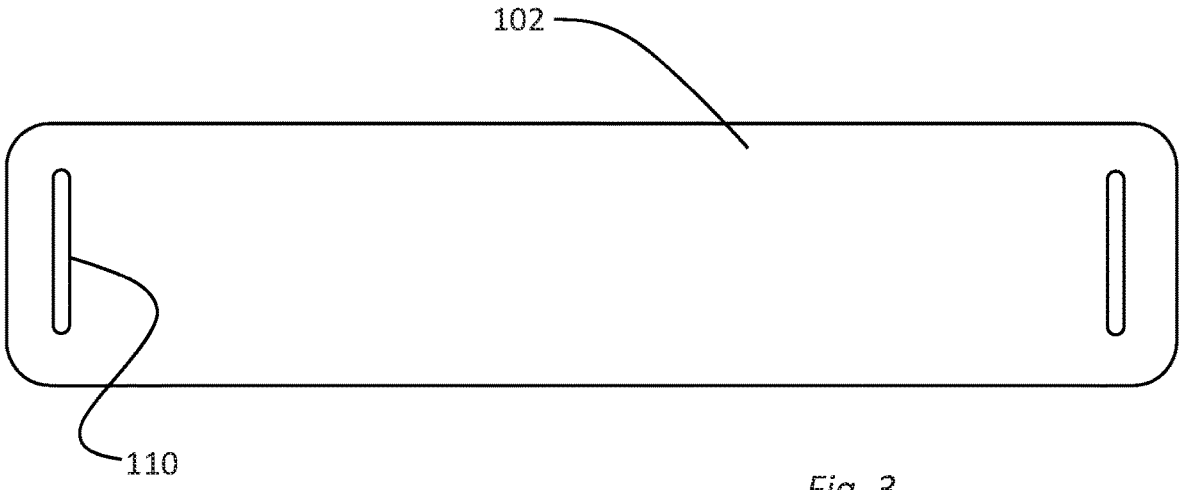
FIG. 3 is a plan view of a food shield panel having a plurality of slots.

As shown in FIG. 3, a panel 102 may include one or more slots 110 cut, molded, or otherwise formed through the panel 102. A slot 110 will typically extend entirely through the panel from a lower exterior surface 112 of the panel 102 to an upper exterior surface 114 of the panel 102. In the embodiment of FIG. 4, two slots 110 are illustrated as being formed perpendicular to the width of the panel. Alternative panel embodiments may include any number of slots 110, and the slots can be formed at any desired angle, or in a curved panel. The panel support 108 can be connected to a panel 102 with certain portions of the panel clamp assembly 300 extending through a slot 110 in the panel. As described in detail below, the portions of the panel clamp assembly 300 extending through a slot 110 can collectively have an overall length less than the length of the slot 110. Thus, when the panel clamp assembly is disengaged or loosened, the panel 102 may be translated forward or backward along line 1 within the range of movement defined by the length of the slot 110 relative to the length of the panel clamp elements extending through the slot.

Figure 4A:
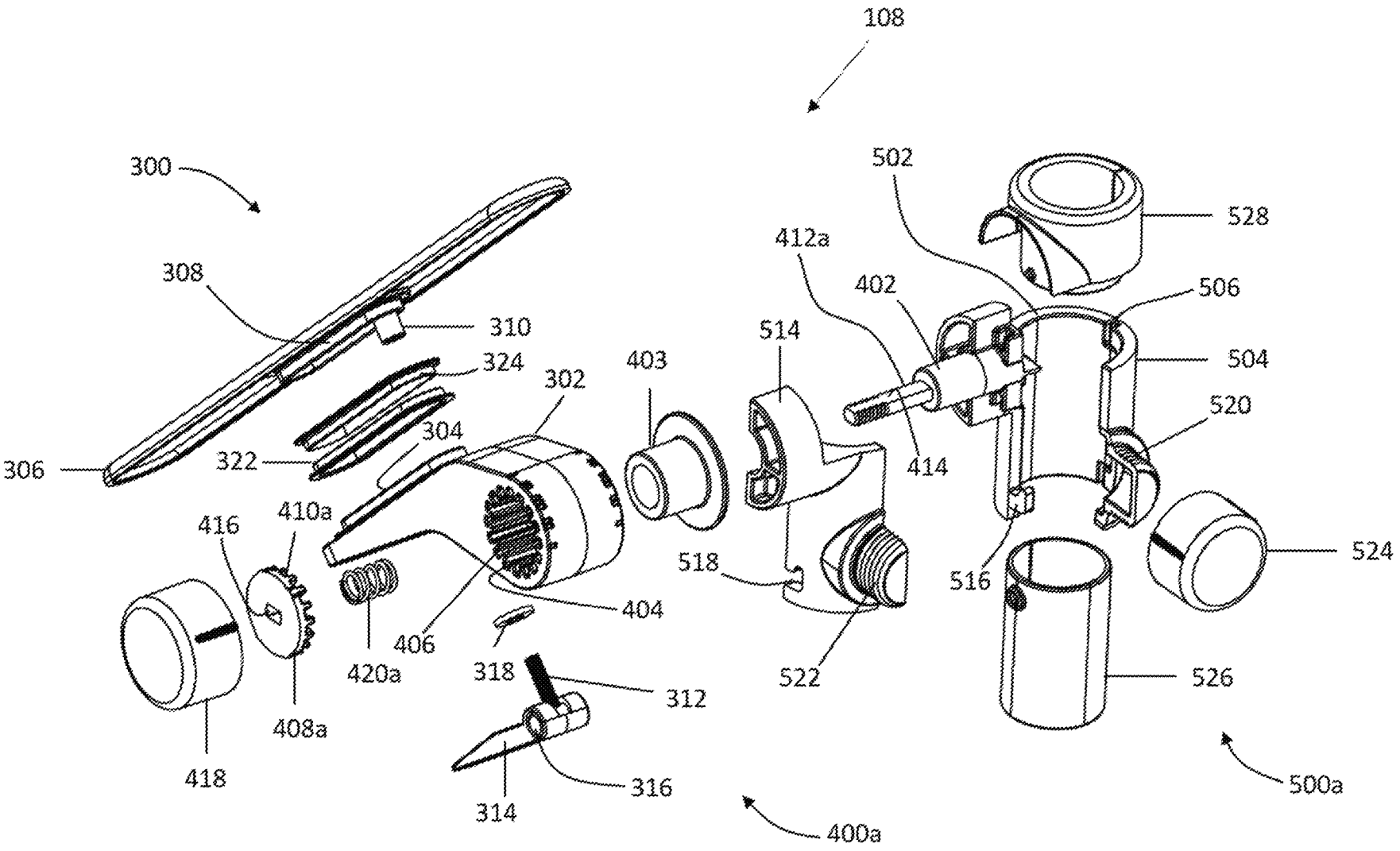
FIG. 4A is an exploded view of an embodiment of a panel support.
Figure 4B:
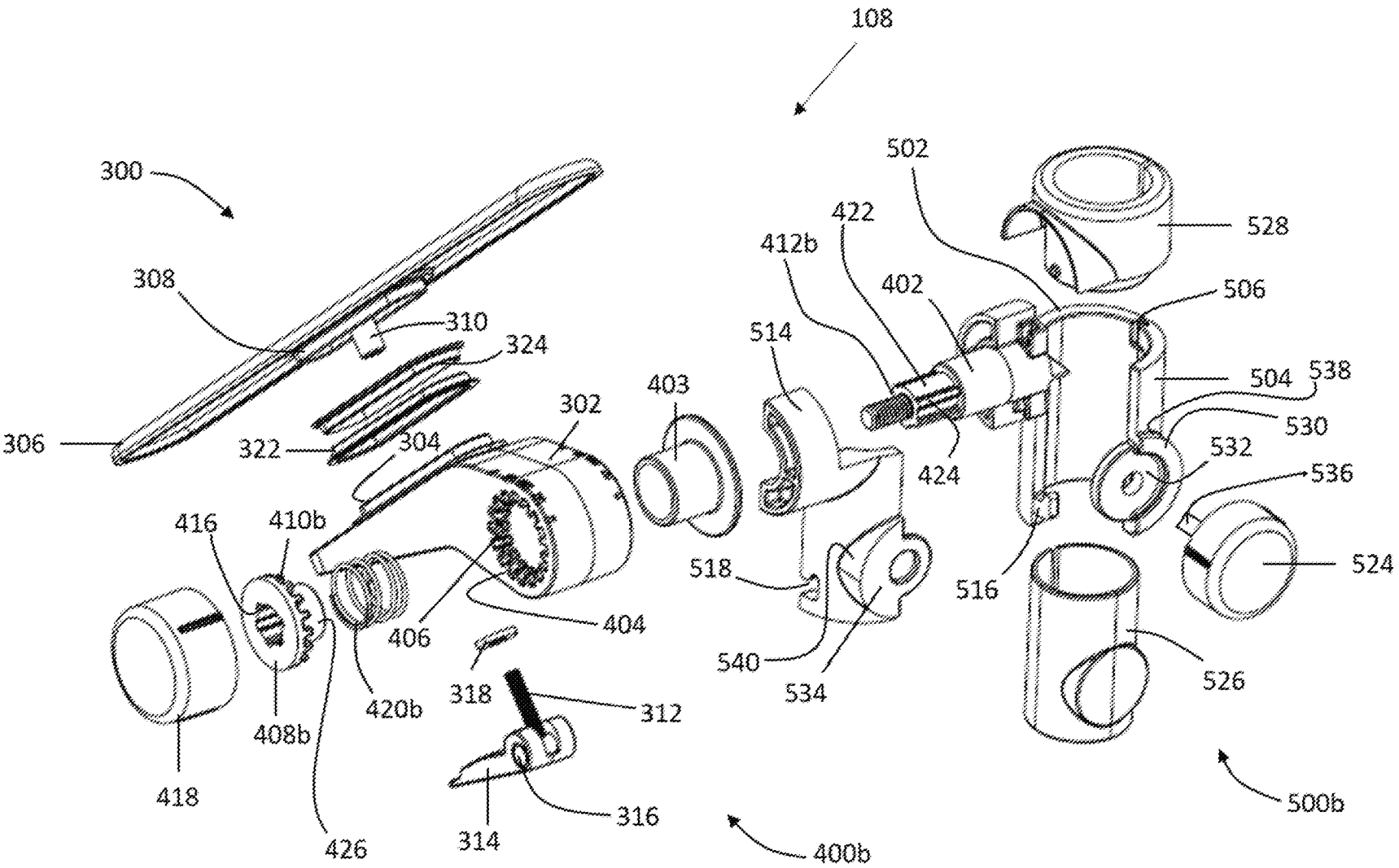
FIG. 4B is an exploded view of an alternative embodiment of a panel support.
Figure 5A:
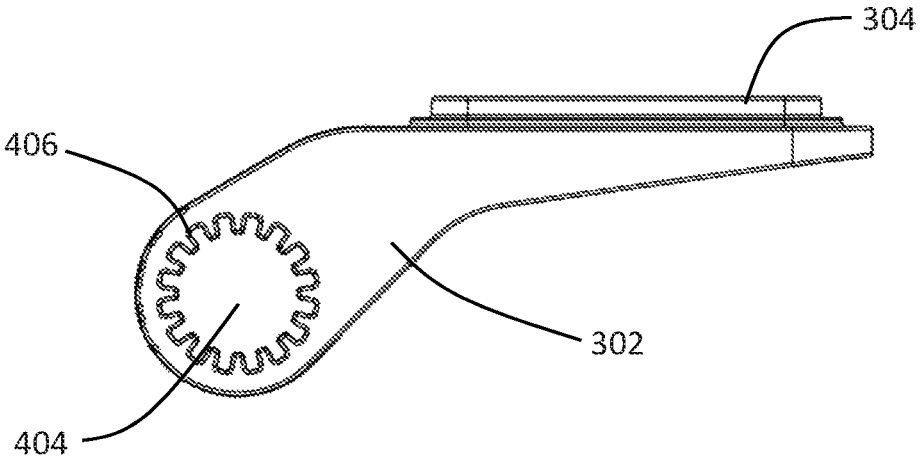
FIG. 5A is a front elevation view of a panel support arm.
Figure 5B:
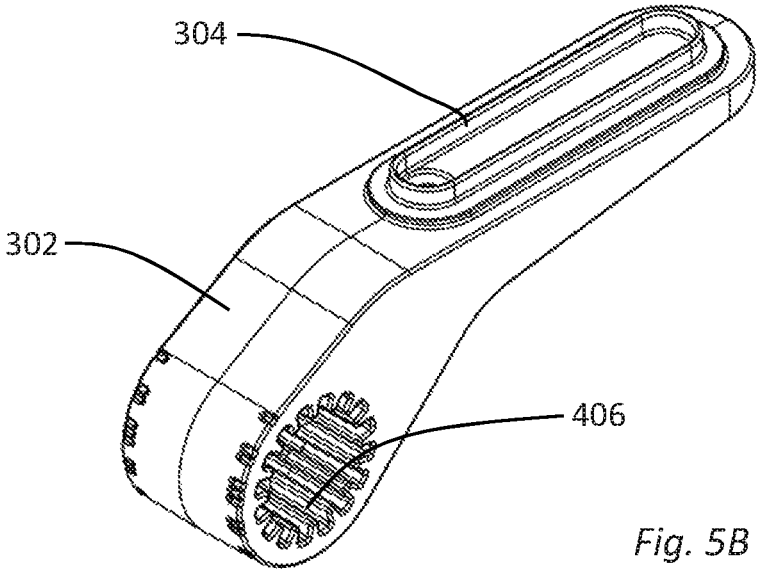
FIG. 5B is a perspective view of a panel support arm.

As best illustrated in FIGS. 4A and 4B, the panel clamp assembly subsystem 300 may include a panel support arm 302 generally configured to support the lower surface 112 of a panel 102. In some embodiments, the panel support arm 302 will include a raised lower guide surface 304 having a width less than a width defined by a corresponding slot 110 through a panel attached to the panel clamp assembly 300. The panel clamp assembly 300 may also include a cover plate 306 which is operatively positioned to directly, or indirectly, contact the upper surface 114 of any panel attached to the panel clamp assembly 300. The cover plate may include an extended upper guide surface 308, which may be configured to match the dimensions of the lower guide surface 304. The cover plate 306 can also include a socket 310.

The socket 310 of the FIG. 4 embodiment is configured to receive a clamping post 312 extending from the underside of the panel support arm 302, through the slot 110, to the socket 310. The socket 310 may be threaded, may have structure for receiving a pin, or may otherwise be configured to securely receive the clamping post 312. The clamping post 312 in the FIGS. 4A and 4B embodiments, is connected to a cam lever 314 away from the cover plate 306. The cam lever 314 includes an offset cam axel 316 and is supported by a formed washer 318 and/or a surface formed in the panel support arm 302, such that articulating the cam lever 314 from an open to a closed position draws the cover plate 306 and associated structures toward the panel support arm 302 to clamp a panel between the panel support arm and the cover plate.

Top and bottom spacers, 320 and 322 respectively, may optionally be included to provide a suitably snug fit between the lower guide surface 304, the upper guide surface 308 and the width of a slot 110 when a food shield system 100 is assembled. The length of the lower and upper guide surfaces, 304 and 306, and the length of the top and bottom spacers, 320 and 322, can be somewhat or significantly less than the length of the slot 110. Thus, when the cam lever 314 is disengaged or loosened, the cover plate 306 moves away from the panel support arm 302 loosening the clamping force is exerted on a panel 102. Then, the panel 102 may be translated forward or backward along line 1 within the range defined by the length of the slot 110. Smooth translation is facilitated by sizing the width of the top and bottom spacers 320, 322 to correspond to the width of the slot 110. Smooth translation may be further facilitated by fabricating the top and bottom spacers 320, 342 from a plastic, PTFE, or elastomeric material which slides smoothly through the slot.

After the panel 102 is translated to a desired location along line 1, the cam lever 314 may be reengaged or tightened to securely lock the panel 102 in the desired location. The panel clamp assembly 300 therefore provides for infinite and micro-adjustable movement of the panel along the line 1, within the defined range. If the panel clamp assembly 300 includes a cam lever 314 or a structure similar to the cam lever 314, the position of the panel 102 may be adjusted without the use of tools. In alternative embodiments, the cam lever 314, clamping post 312, formed washer 318, and/or socket 310 elements may be replaced with conventional nuts and bolts, a threaded knob, other clamping structures, screws or the like which can provide for the panel 102 to be clamped against the panel support arm 302 at selected positions.

In certain embodiments, the cover plate 306 may be fabricated to have a length and width greater than the length and width of a corresponding slot 110. Having a cover plate 306 with an overall width greater than the width of the slot 110 causes the cover plate 306 to effectively clamp the upper surface 114 of a panel 102 when the cam lever 314 or other clamping mechanism is articulated. Providing a cover plate 306 with a length greater than the length of the slot 110 give certain functional and aesthetic advantages as well. As best illustrated by comparing FIG. 5A to FIG. 5B, a relatively long cover plate can cover the entirety of the slot 110 if the panel 102 is translated fully forward (FIG. 5A) or fully rearward (FIG. 5B) within the translational range defined by the length of the slot 110.

An alternative panel clamp assembly subsystem 330 is illustrated in FIGS. 8-12. The panel clamp assembly subsystem 330 facilitates the positioning of a panel 102 along line 1 without the need to form a slot 110 through the panel 102. Thus, the panel clamp assembly subsystem 330 may be implemented with a panel 102 having conventional mounting holes drilled or otherwise formed through the panel 102, or with a panel having no perforations.

Figure 10:
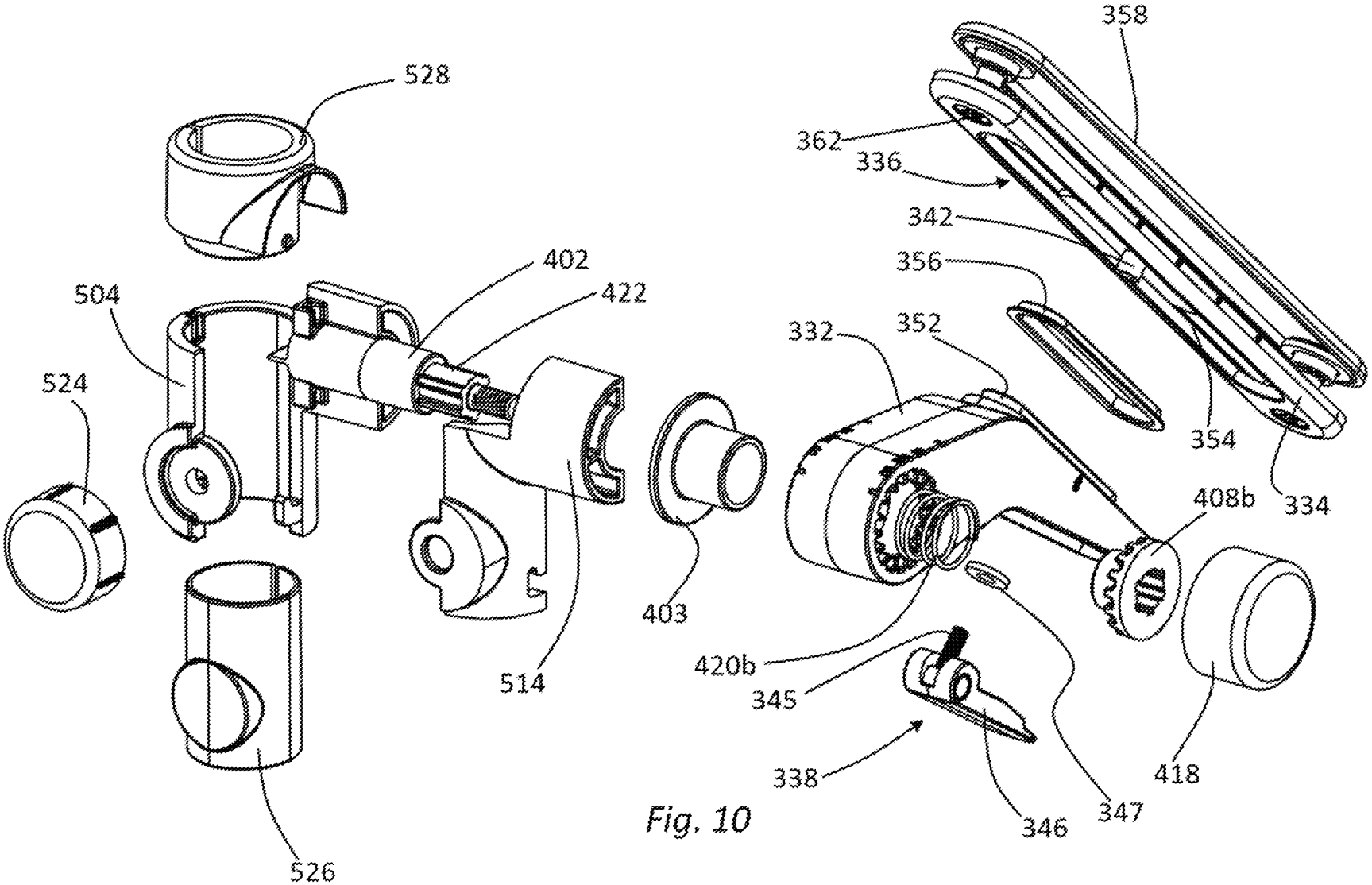
FIG. 10 is an exploded view of the alternative panel support of FIG. 8.
Figure 11A:
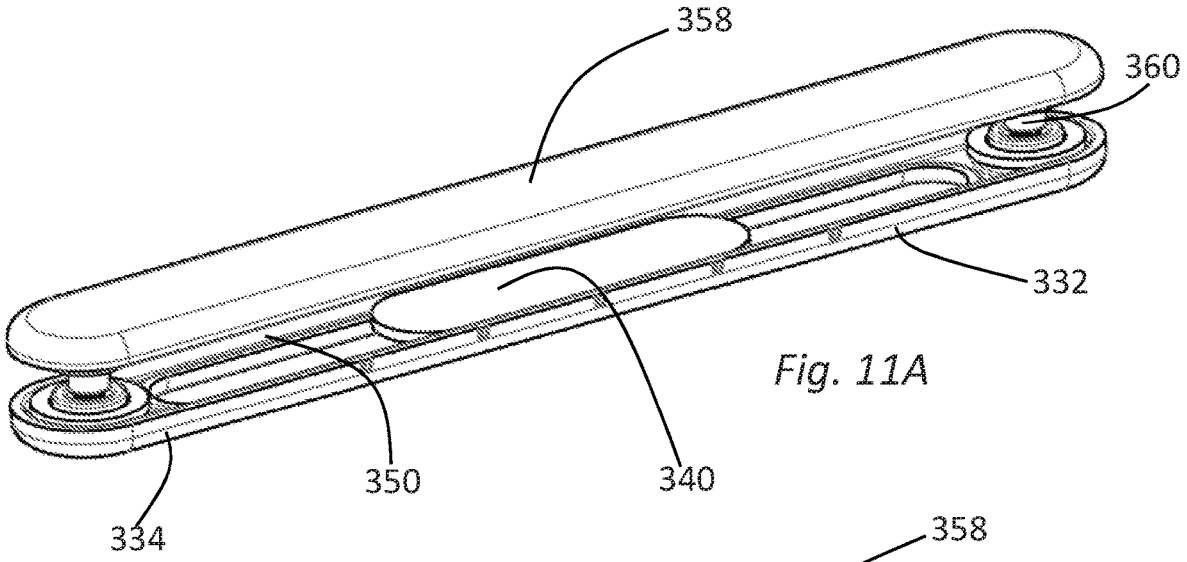
FIG. 11A is a front perspective view of a panel support plate, cover plate, and associated apparatus.
Figure 11B:
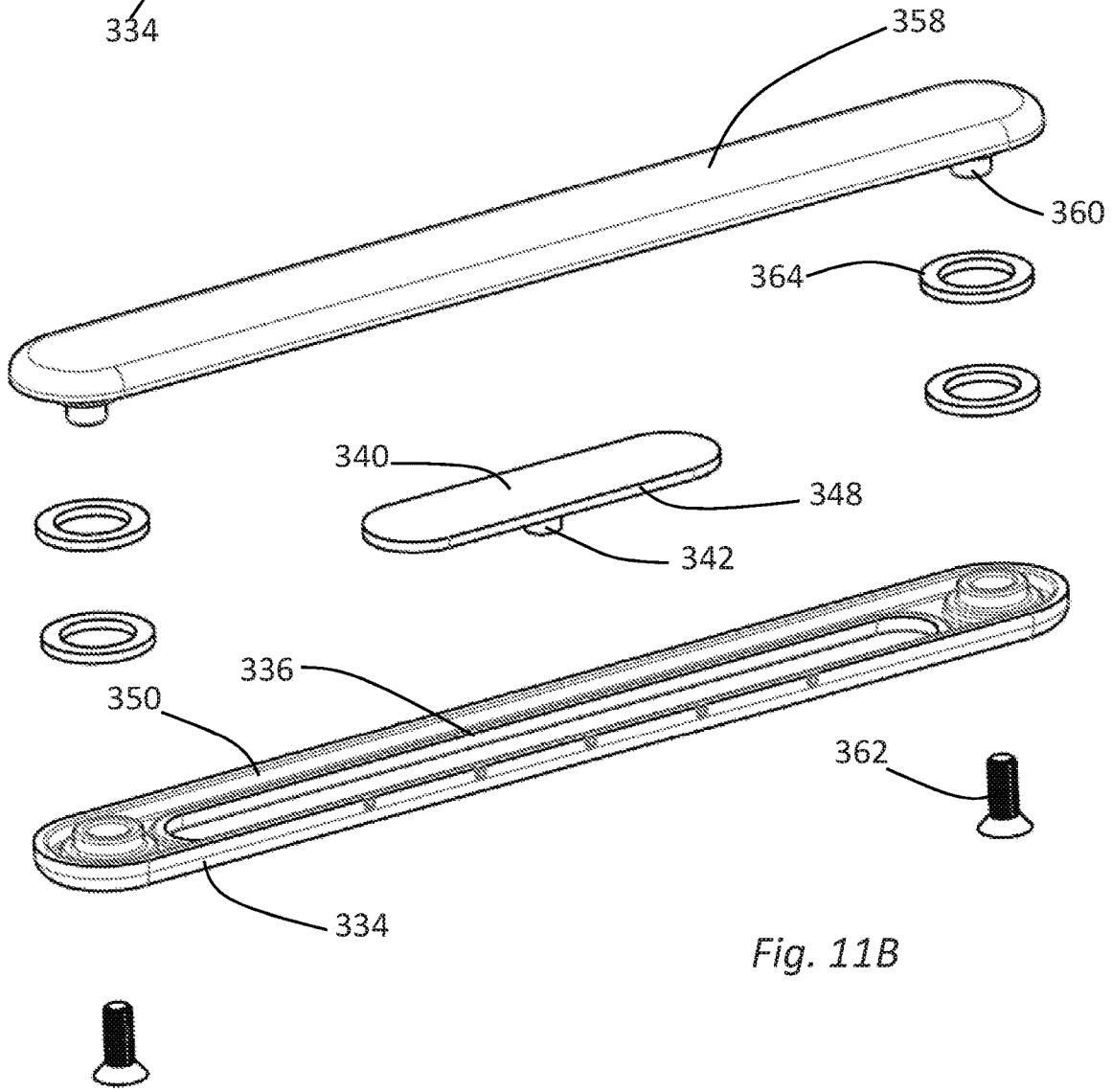
FIG. 11B is an exploded view of the panel support plate, cover plate and associated apparatus of FIG. 11A.

As shown in FIGS. 8-12, the panel clamp assembly subsystem 330 includes a panel support arm 332 connected to a panel support plate 334. The panel support plate 334 defines a longitudinal slot 336 having a selected length. As best shown in FIG. 10, the panel support plate 334 is connected to the panel support arm 332 with a tensioning apparatus 338 extending in part through the slot 336.

In one embodiment, the tensioning apparatus 338 includes a flange 340 extending from a socket post 342. When operatively positioned, the socket post 342 extends through the slot 336 and the flange 340 abuts an upper surface of the panel support plate 334. The tensioning apparatus also includes a clamping mechanism 344 attached to the socket post 342 opposite the flange, for example with a threaded connection 345. The clamping mechanism 344 may be any type of mechanism which can be operated to move the flange 340 toward or away from the panel support arm 332 to clamp or unclamp the panel support plate 334 to the panel support arm 332. In the illustrated embodiment, the clamping mechanism 344 is a cam lever 346 having an eccentric cam surface or an eccentric cam axel, with the cam lever abutting the panel support arm 332 or a formed washer 347 that abuts the panel support arm 332.

Alternative clamping mechanisms 344 include, but are not limited to, bolts, nuts, wing nuts, levers or other apparatus which may be employed to apply tension to the socket post 342 and flange 340 assembly, or to release tension from the socket post 342 and flange 340 assembly.

The tensioning apparatus 338 may be operated to secure the position of the panel support plate 334 at any selected position along the length of the slot 336. Thus, the position of the panel support plate 334 relative to the panel support arm 332 is infinitely adjustable along the length of the slot. The tensioning apparatus 338 may also be operated to unsecure or loosen the panel support plate 334, permitting the panel support plate to be moved and re-positioned along the length of the slot relative to the panel support arm 332. As noted above, a panel 102 is typically mounted to the panel support plate. Thus, the panel support arm 332, panel support plate 334 and tensioning apparatus 338 provide an alternative apparatus for adjusting the position of a panel 102 along the line 1, relative to a panel support 108, as illustrated in FIG. 1A.

In embodiments where the clamping mechanism 344 includes a cam lever 346, the adjustment of the position of the panel support plate 334 and any attached panel 102 may be accomplished without the use of tools. Furthermore, adjustment of the position of the panel support plate 334 or any attached panel 102 is infinitely variable and therefore not limited to adjustment in predetermined steps, adjustment to defined positions, or adjustment in predetermined increments.

Certain elements illustrated in FIGS. 8-12 serve to enhance the stability of the interface between the panel support arm 332 and panel support plate 334. For example, embodiments may include a flange 340 having substantially linear longitudinal edges 348, which in use are positioned parallel to the length of the slot 336. In addition, the panel support plate 334 may include edges defining an upper track 350 having a width slightly greater than the distance between the substantially linear longitudinal edges 348 of the flange 340. Thus, the flange 340 can slide in the upper track with the socket post 342 extending through the longitudinal slot 336 with the substantially linear longitudinal edges 348 of the flange being guided by the upper track 350. This configuration limits binding by minimizing possible rotation of the flange 340 or the panel support plate 334 as it is moved.

Stability of the system may further be enhanced by providing the panel support arm 332 with a guide surface 352 having straight edges that mate with a lower track 354 defined by the panel support plate. Correspondence between the edges of the guide surface 352 and the lower track 354 also serves to stabilize and limit rotation or binding of the panel support plate 334 as the panel support plate is translated over the guide surface 352 of the panel support arm 332.

Smooth translation of the panel support plate 334 over the panel support arm 332 may be enhanced by providing a bushing 356 between the guide surface 352 and the lower track 354. The bushing 356 may be fabricated from any suitable material including but not limited to PTFE or similar polymers, plastics, metals or other material having suitable hardness and friction characteristics.

Stable and secure clamping may be further enhanced by treating the underside surface of the flange 340 and/or an upper surface of the panel support plate 334 or upper track 350 to increase friction between these parts when the tensioning apparatus 338 is tightened. For example, the underside surface of the flange 340 or upper surface of the panel support plate 334 may be sandblasted, etched, otherwise roughened, or have a friction increasing material applied to one or both surfaces.

Figure 12:
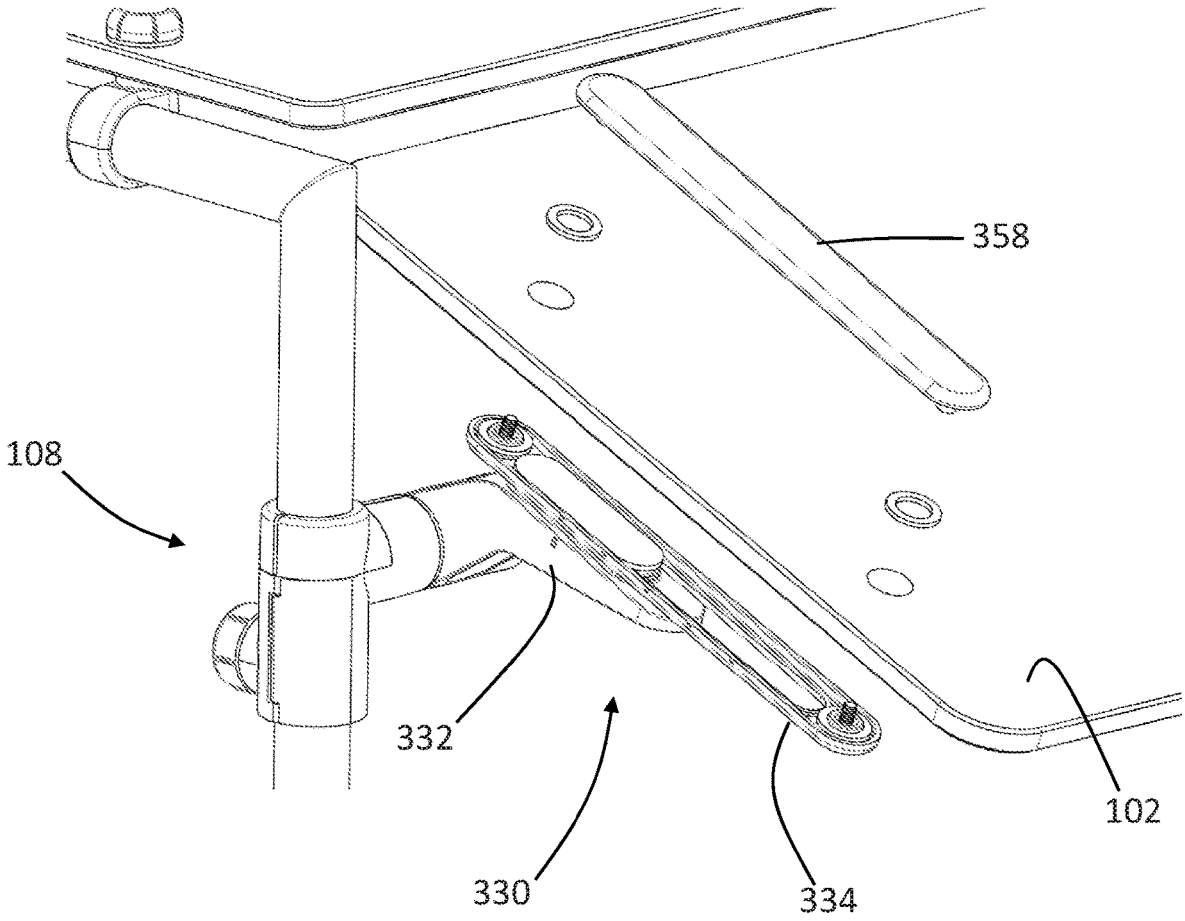
FIG. 12 is an exploded view of a panel in position for mounting using the alternative panel support of FIG. 8.

The alternative panel support subsystem 330 may include a cover plate 358 connectable to the panel support plate 334. The cover plate 358 serves to secure a panel 102 to the panel support arm 332, and to cover and conceal any holes formed through the panel 102. The cover plate 358 may be attached to the panel support plate 334 in any fashion. In the illustrated embodiment, the cover plate 358 includes extension posts 360 extending downward from the cover plate 358 that are threaded to receive screws 362 extending through the panel support plate 334. Thus, as shown in FIG. 12, a panel 102 having simple mounting holes may be secured between a panel support plate 334 and a cover plate 358 by tightening screws 362 into the threaded extension post 360. The panel may further be positioned and supported by selected bushings or washers 364.

In an alternative embodiment, the panel 102 might have no perforations at all, and be affixed to the panel support plate 334 using an adhesive. In such an embodiment, an optional cover plate 358 may also be affixed to the top surface of the panel 102 with an adhesive.

In any embodiment, the panel support 108 might further include a pivoting connection 400*a*, 400*b*, that connects a stand clamp assembly 500 to the panel clamp assembly 300. Two exemplary pivoting connections 400*a* and 400*b*, are illustrated in FIGS. 4A and 4B respectively. A pivoting connection 400*a*, 400*b*, can permit the angular orientation of a panel 102 to be adjusted or positioned around axis r, as shown in FIG. 1A. The 400*a* and 400*b* pivoting connection embodiments includes a shaft 402 extending from a portion the stand clamp 500 through an opening 404 in the panel support arm 302. The shaft 402 defines a pivot axis, corresponding to axis r, around which the panel support arm 302 and any attached structures may rotate or pivot. Smooth panel support arm rotation can be facilitated by providing an optional bushing 403, bearings, a bearing surface or other structure between the shaft 402 and opening 404. In the FIG. 4A and FIG. 4B embodiments, the opening 404 includes an array of perimeter engagement slots 406 extending at least partially through the panel support arm 302.

As shown in FIG. 4A, the pivoting connection 400*a* might additionally include a tooth plate 408*a* having one or more teeth 410*a* sized or otherwise formed to selectively engage and disengage with the array of perimeter engagement slots 406. The shaft 402 may include a threaded extension 412*a* having a flattened surface 414 that extends through a corresponding flattened opening 416 in the tooth plate 408*a*. A pivot locking knob 418 may be threaded onto or otherwise connected to the threaded shaft 412*a*.

Thus, in the FIG. 4A embodiment, when the pivot locking knob 418 is threaded toward the stand clamp 500 along the threaded extension 412*a*, one or more teeth 410*a* on the tooth plate 408*a* is moved into engagement with the array of perimeter engagement slots 406. Conversely, when the pivot locking knob 418 is threaded away from the stand clamp 500 the teeth 410*a* and tooth plate 408*a* can be moved out of engagement with the perimeter engagement slots 406 by action of the compression spring 420*a*, a wave washer, a compressible elastomeric bushing, or similar apparatus. In alternative embodiments, the pivot locking knob 418 could be replaced with a bolt, cam, wingnut or similar structure.

In the FIG. 4A embodiment, when the teeth 410*a* are moved into engagement with the perimeter engagement slots 406, the panel support arm 302 is prevented from pivoting around the shaft 402, and therefore locked into place, because the engagement of the flattened opening 416 of the tooth plate 408*a* with the flat surface 414 of the threaded extension 412*a* prohibits the tooth plate 408*a* from rotating around the pivot axis. Furthermore, the foregoing structures permit the panel support arm 302 to rotate around the pivot axis defined by the shaft 402 when the tooth plate 408*a* is disengaged from the panel support arm 302. These, or similar structures, facilitate angular pivot arm/panel adjustment and then locking of the angular orientation of the pivot arm 302 and panel 102 with respect to an associated stand 104 or base 106.

A representative alternative pivoting structure 400*b* is illustrated in FIG. 4B. The FIG. 4B embodiment also includes a shaft 402 extending from a portion the stand clamp 500 through an opening 404 in the panel support arm 302 as described above. In the FIG. 4B embodiment, the opening 404 also includes an array of perimeter engagement slots 406 extending at least partially through the panel support arm 302. The FIG. 4B embodiment includes an alternative tooth plate 408*b* having one or more teeth 410*b* sized or otherwise formed to selectively engage and disengage with the array of perimeter engagement slots 406. The shaft 402 may include an extension 422 having one or more raised ridges 424 that mate with a corresponding opening 416*b* in the tooth plate 408*b* when the pivoting connection 400*b* is assembled. The extension 422 may have any number of raised ridges, slots, non-circular portions, flattened regions, extensions, depressions, or other structure configured to mate with a corresponding opening 416*b* of the tooth plate 408*b*, such that the tooth plate 408*b* is prevented from rotating around the extension 422 when the pivoting structure 400*b* is assembled.

The tooth plate 408*b* may include a bearing surface 426 facing the stand clamp 500. The bearing surface 426 can cooperate with optional bushing 403, bearings, another surface or other structure between the shaft 402 and opening 404 to facilitate smooth rotation of the support arm 302 around the shaft 402. Thus, the bearing surface 426 may be sized to match the exterior supporting surface of the bushing 403, sized to fit within the bushing 403 or otherwise sized and formed to smoothly support the support arm 302.

A pivot locking knob 418 may be threaded onto or otherwise connected to the threaded shaft 412*b*. Thus, in the FIG. 4B embodiment, when the pivot locking knob 418 is threaded toward the stand clamp 500 along the threaded shaft 412*b*, one or more teeth 410*b* on the tooth plate 408*b* is moved into engagement with the array of perimeter engagement slots 406. Conversely, when the pivot locking knob 418 is threaded away from the stand clamp 500 the teeth 410*b* can be moved out of engagement with the perimeter engagement slots 406 by action of the compression spring 420*b* or similar biasing apparatus. In alternative embodiments, the pivot locking knob 418 could be replaced with a bolt, cam, wingnut or similar structure.

In the FIG. 4B embodiment, when the teeth 410*b* are moved into engagement with the perimeter engagement slots 406, the panel support arm 302 cannot pivot around the shaft 402 because the engagement of the opening 416*b* of the tooth plate 408*b* with the profile of the extension 422 prohibits the tooth plate 408*b* from rotating around the pivot axis. Thus, the foregoing structures permit the panel support arm 302 to rotate around the pivot axis defined by the shaft 402 when the teeth 410*b* of the tooth plate 408*b* are disengaged from the panel support arm 302 and prohibit rotation when a tooth or teeth 410*b* are engaged with the panel support arm 302. These, or similar structures, facilitate the angular positioning of the pivot arm 302 with respect to an associated stand 104 or base 106.

Alternative pivoting connection embodiments may include simple nuts and bolts, threaded shafts, bearings, friction plates, brakes or other structures facilitating the angular adjustment and locking of a panel support arm in the desired orientation. The illustrated embodiments may be locked or unlocked to permit the angular adjustment of a panel 102 around axis r of FIG. 1A, without the use of tools.

Figure 6A:
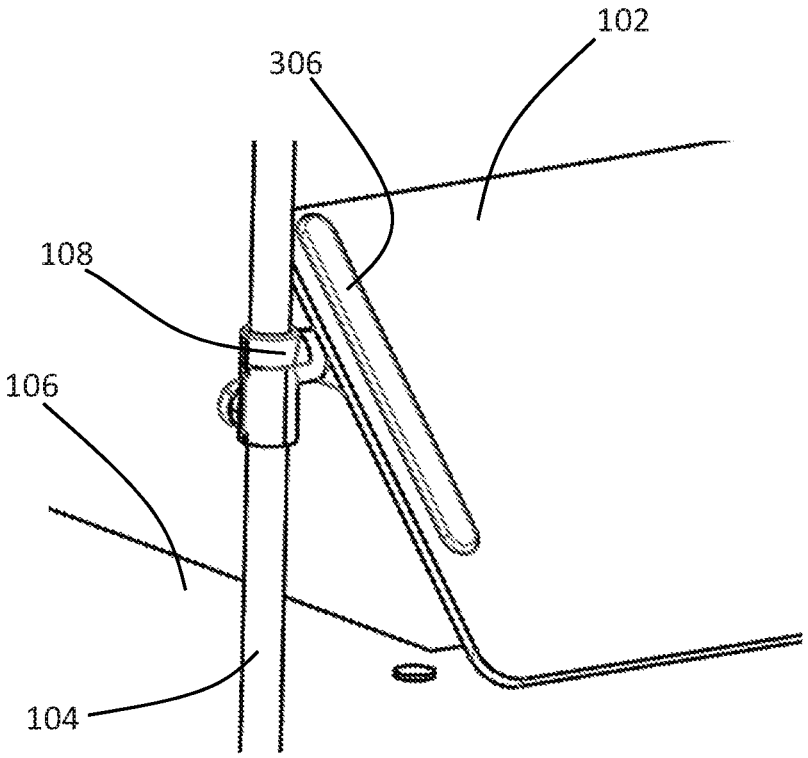
FIG. 6A is a perspective views of portions of a panel, cover plate, panel support, and stand in a first position.
Figure 6B:
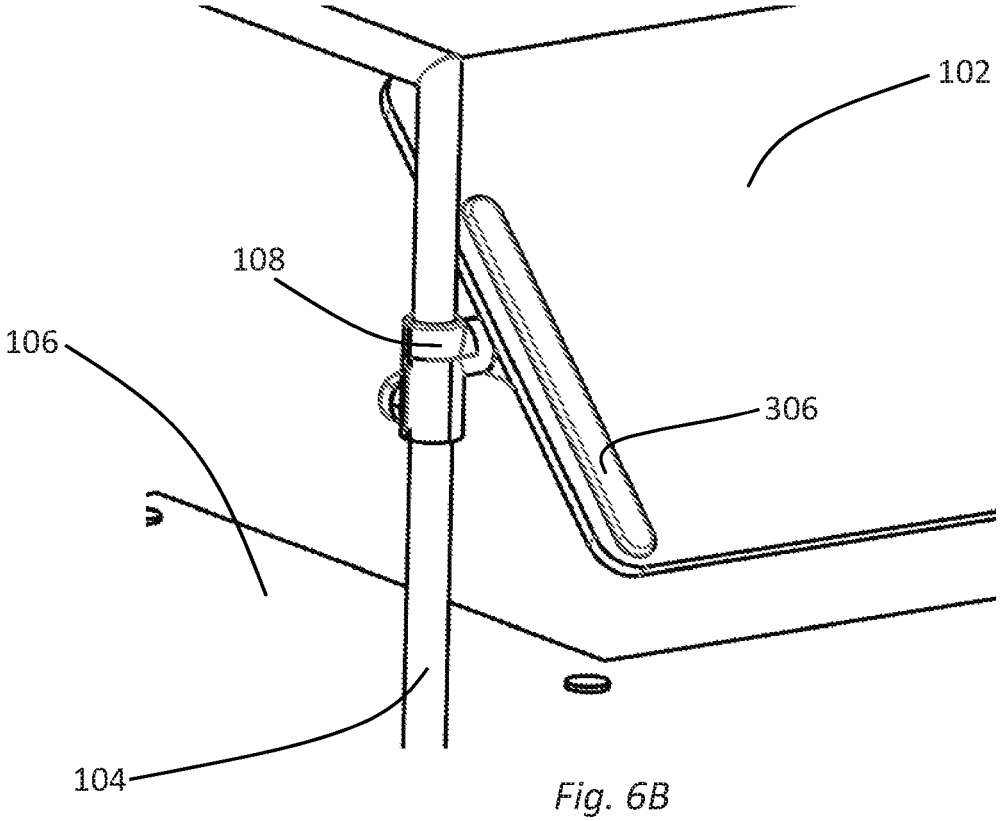
FIG. 6B is a perspective views of portions of a panel, cover plate, panel support, and stand in a second position.
Figure 7A:
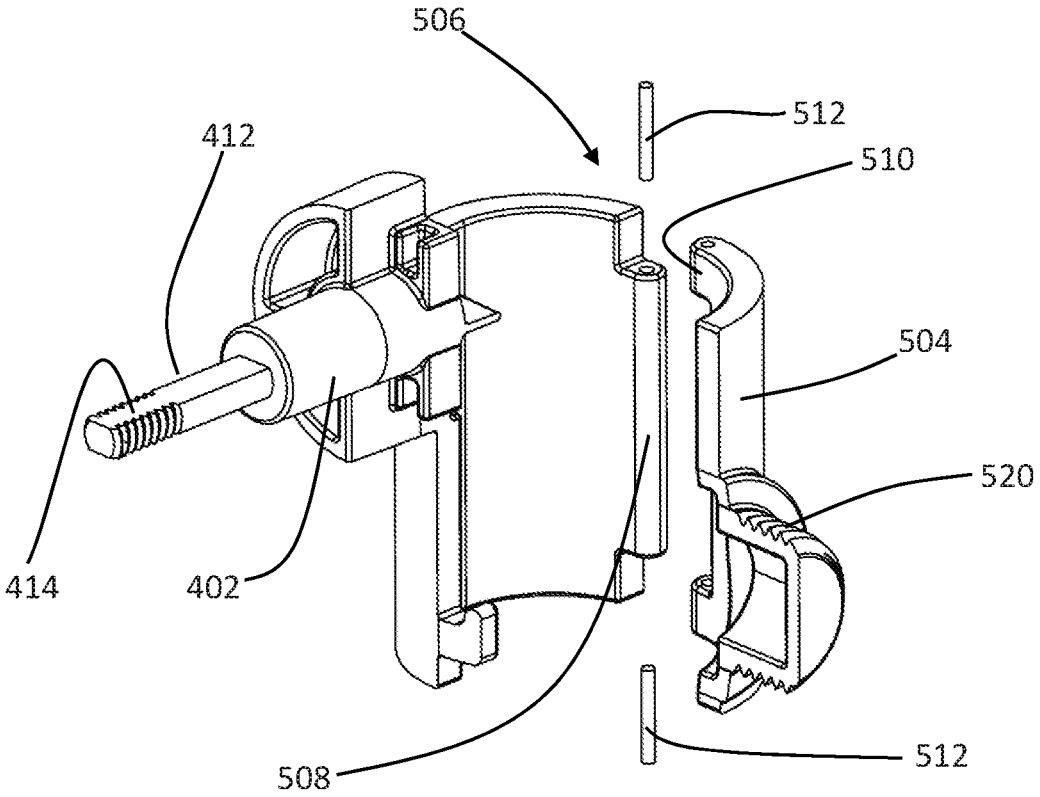
FIG. 7A is an exploded, perspective view of portions of a stand clamp.
Figure 7B:
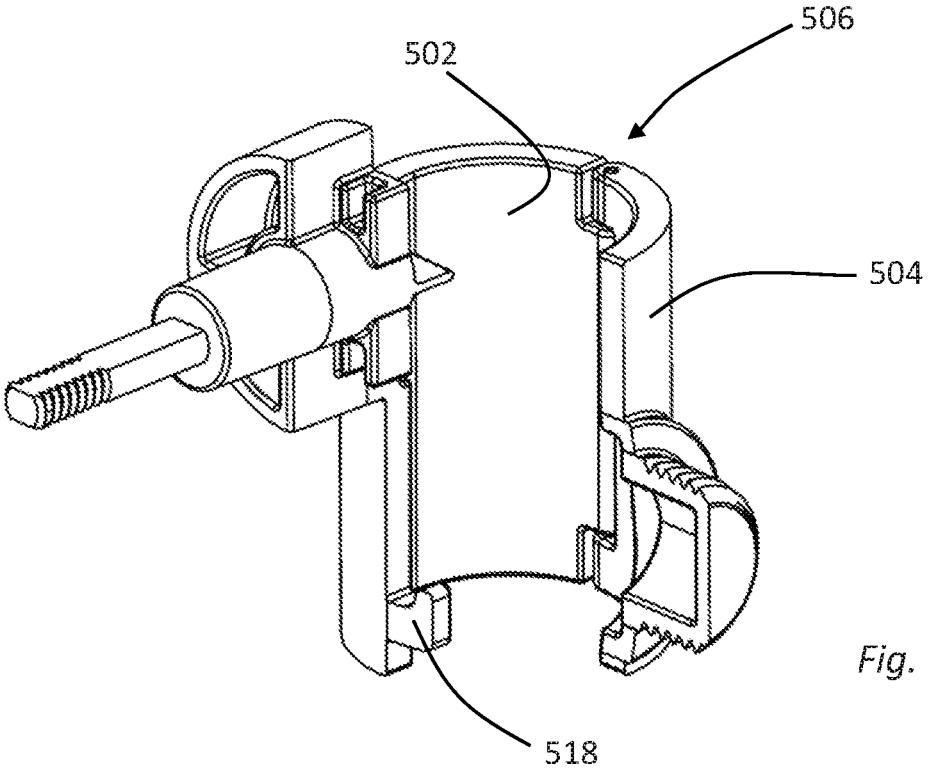
FIG. 7B is a perspective view of portions of a stand clamp.
Figure 8:
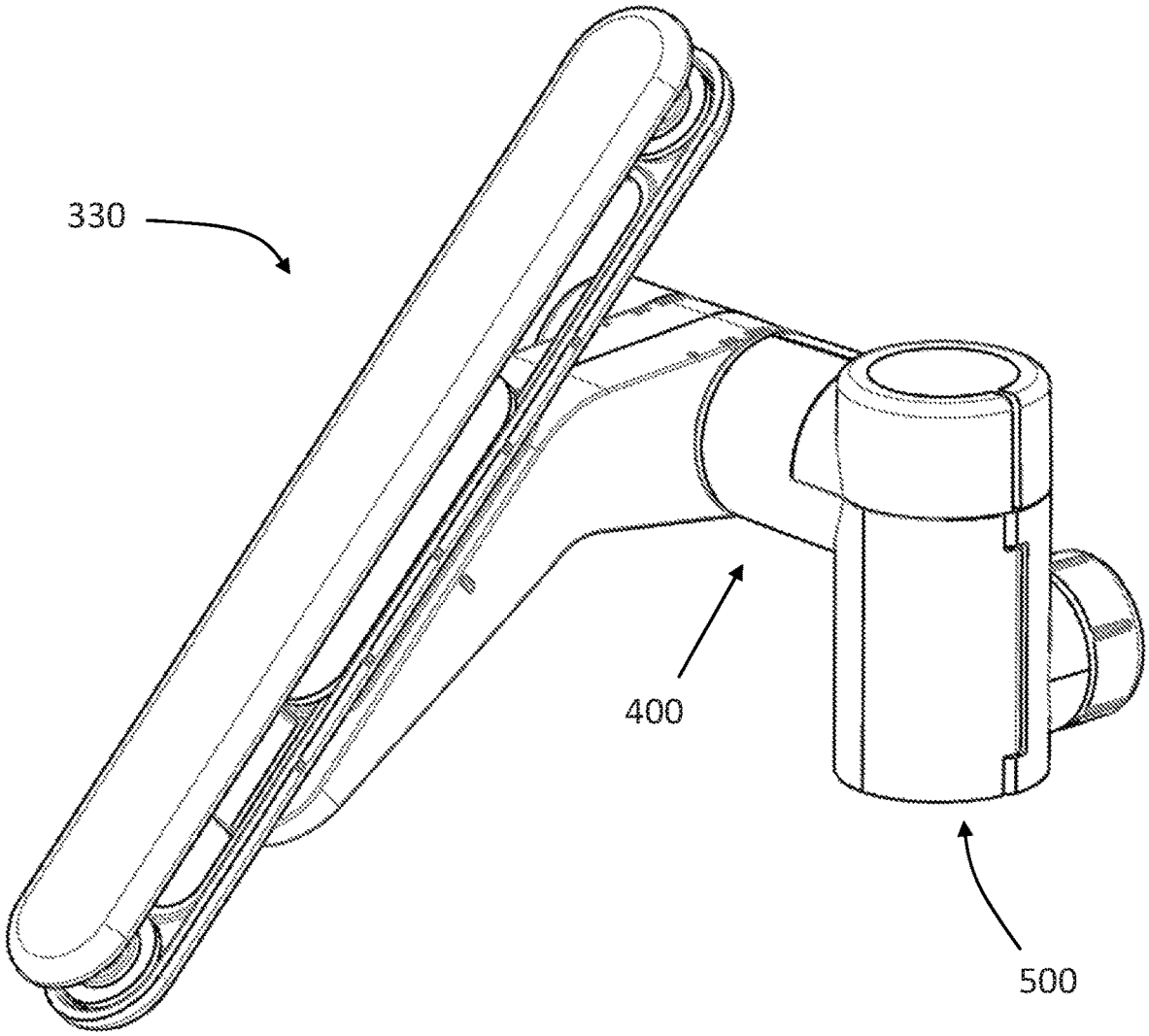
FIG. 8 is a front perspective view of an alternative panel support.
Figure 9:
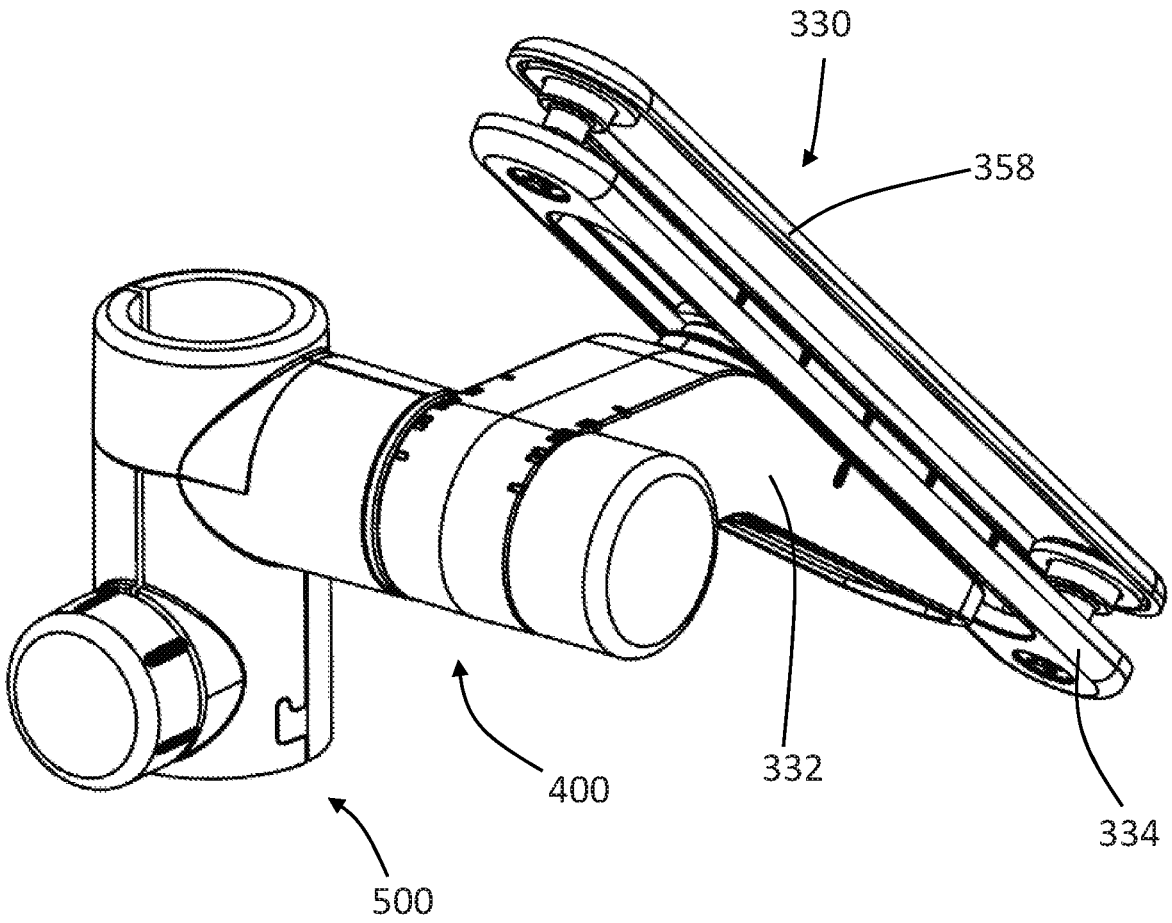
FIG. 9 is a rear perspective view of the alternative panel support of FIG. 8.

The panel support 108 might additionally include a stand clamp 500*a*, 500*b*. The stand clamp 500*a*, 500*b* serves to attach a panel support 108 to a stand 104 or another structure. In some embodiments, the stand clamp 500*a*, 500*b*, can be attached to a stand without the use of tools. An exemplary stand clamp 500*a*, as illustrated in FIG. 4A. The 500*a* stand clamp embodiment might include a first clamp portion 502 and a second clamp portion 504 that can be connected together with a hinge 506. The hinge 506 provides for the interior clamping surfaces of the first and second clamp portions 502 and 504 to be opened for removal from a stand 104 or closed to engage a stand 104, post or other structure. A representative hinge 506 is shown in FIGS. 6A and 6B. the illustrated hinge 506 includes an integral center hinge portion 508 formed in the first clamp portion 502 and corresponding integral outer hinge portions 510 formed in the second clamp portion 504. The hinge portions 508, 510 are joined together with one or more hinge pins 512.

Returning to FIG. 4A, the representative stand clamp 500*a* also includes a third clamp portion 514 that can be substantially rigidly connected to the first clamp portion 502 with suitable structures, for example extension 516 and keyway 518. Providing a first clamp portion 502 and a third clamp portion 514 that can be separated facilitates clamp removal for cleaning, replacement, or other tasks. In alternative embodiments the first and third clamp portions 502, 514 can be replaced with a single structure or with multiple structures permanently bonded together.

Various clamp portions must be drawn together to effectively clamp a stand 104, post, or other structure. To accomplish clamp tightening, the second clamp portion 504 may include a first threaded semicircular extension 520. The third clamp portion 514 may include a corresponding second threaded semicircular extension 522. When assembled around a stand 104, the first and second threaded semicircular extensions 520, 522 are adjacent to each other but separated by a gap or space. Both of the threaded extensions may together define a tapered thread surface that can be received in the threaded female socket of a threaded clamping knob 524. In this embodiment, the thread surfaces on each semicircular extension are tapered, for example with a conventional pipe thread taper. Thus, when the clamping knob 524 is threaded toward the second and third clamp portions 504, 514 engagement of the tapered thread profile on the semicircular extensions 520, 522 with a corresponding female thread taper in the clamping knob 524 draws the semicircular extensions 520, 522 toward each other, narrowing the gap between them. This action securely clamps each of the clamp portions around a portion of a stand 104, a post, or similar structure.

When the clamping knob 524 is loosened, the tapered threads of the clamping knob 524 and each semicircular extension permit the semicircular extensions to separate from each other while still remaining loosely engaged with a portion of a stand 104. In a loosened configuration, the entire panel support 108 may be moved relative to the stand 104, for example moved up or down along line h of FIG. 1A. Furthermore, the entire panel support may be rotated around axis a when the clamping knob 524 is loosened. If the clamping knob 524 is completely unthreaded and removed, the semicircular extensions 520, 522 may be widely separated through action of the hinge 506 and the stand clamp 500*a* removed for replacement, cleaning or maintenance. In the FIG. 4A embodiment, each of the above actions may be accomplished without the use of tools.

The stand clamp 500*a* of FIG. 4A also includes a sleeve 526 which provides for smooth, non-binding positional adjustment without marring any portion of a post or stand 104. The sleeve 526 may be fabricated from nylon, plastic, PTFE or a similar material. This embodiment also includes a top collar 528 which protects portions of the stand clamp 500*a* and pivoting connection 400*a* from contamination and provides aesthetic advantages.

An alternative stand clamp 500*b* is illustrated in FIG. 4B. In the alternative embodiment, the first, second, and third clamp portions and hinge operate generally as described above. The second clamp portion 504 includes a socket 530 that receives a portion of washer 532. The third clamp portion 514 may include a capture structure 534 also configured to receive a portion of the washer 532. When the stand clamp 500*b* is assembled, the capture structure 534 and socket 530 are adjacent to each other but separated by a gap permitting the clamp 500*b* to be tightened around a post.

In the 500*b* embodiment, the clamping knob 524 includes a threaded shaft 536 extending toward the washer 532. The threaded shaft 536 may engage with mating threads formed in the washer 532, engage with a nut behind the washer 532 or otherwise be in threaded engagement with the washer. Therefore, turning the clamping knob in the appropriate direction draws the clamping knob 524 toward the washer 532. The clamping knob may then engage with a structure on the second and third clamp portions, 504, 514 to draw these portions toward each other as the knob is tightened. For example, an inner surface of the clamping knob 524 may engage with sloped side walls 538 and 540 on the second clamp portion 504 and third clamp portion 514 respectively. In alternative embodiments, other tightening and loosening means including but not limited to nuts, bolts, straps, screws, cam levers and the like may be used to attach a panel support 108 to a stand 104.

When the clamping knob 524 is partially loosened in this embodiment, the second and third clamp portions 504 and 514 separate from each other while still remaining loosely engaged with a portion of a stand 104. In a loosened configuration, the entire panel support 108 may be moved relative to the stand 104, for example moved up or down along line h of FIG. 1. Furthermore, the entire panel support may be rotated around axis a when the clamping knob 524 is loosened. If the clamping knob 524 is completely unthreaded and removed, second and third clamp portions, 504, 514 may be widely separated through action of the hinge 506 and the stand clamp 500*a* removed for replacement, cleaning or maintenance. In the FIG. 4B embodiment, each of the above actions may be accomplished without the use of tools.

The stand clamp 500*b* of FIG. 4B also includes a sleeve 526 which provides for smooth, non-binding positional adjustment without marring any portion of a post or stand 104. The sleeve 526 may be fabricated from nylon, plastic, PTFE or a similar material. This embodiment also includes a top collar 528 which protects portions of the stand clamp 500*a* and pivoting connection 400*a* from contamination and provides aesthetic advantages.

Having described certain exemplary embodiments, it will be understood by those skilled in the art that many changes in construction and widely differing embodiments and applications of the invention will suggest themselves without departing from the scope of the present invention.

Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A food shield panel support comprising:

a panel support arm;

a panel support plate defining a longitudinal slot; and a tensioning apparatus extending through the slot and connecting the panel support plate to the panel support arm, wherein the tensioning apparatus may be operated to permit the position of the panel support plate with respect to the panel support arm to be adjusted to any one of an infinite number of positions along a length of the slot, and wherein the tensioning apparatus may be further operated to secure the position of the panel support plate at any one of the infinite number of positions along the length of the slot; wherein the tensioning apparatus comprises:

a flange received in the longitudinal slot;

a clamping post connected to the flange and extending through the slot to the panel support arm; and a clamping mechanism connected to the clamping post.

2. The food shield panel support of claim 1 wherein the clamping mechanism comprises a cam lever that can be operated without the use of tools.

3. The food shield panel support of claim 1 wherein the support plate defines an upper track above the slot, and wherein the flange is received within the upper track.

4. The food shield panel support of claim 3 wherein the flange comprises opposing substantially linear longitudinal edges that mate with the upper track to limit rotation of the flange and the panel support plate as the position of the panel support plate with respect to the panel support arm is adjusted.

5. The food shield panel support of claim 3 wherein an underside surface of the flange is treated to increase friction between the flange and the upper track, when the tensioning apparatus is operated to secure the position of the panel support plate.

6. The food shield panel support of claim 1 further comprising a cover plate connected to the panel support plate and spaced away from the panel support plate to receive a panel between the panel support plate and the cover plate.

7. A food shield panel support comprising:

a panel support arm;

a panel support plate defining a longitudinal slot; and a tensioning apparatus extending through the slot and connecting the panel support plate to the panel support arm, wherein the tensioning apparatus may be operated to permit the position of the panel support plate with respect to the panel support arm to be adjusted to any one of an infinite number of positions along a length of the slot, and wherein the tensioning apparatus may be further operated to secure the position of the panel support plate at any one of the infinite number of positions along the length of the slot;

a guide surface on the panel support arm; and a lower track on the panel support plate, wherein correspondence between the guide surface and the lower track limits rotation of the panel support plate away from a line defined by the longitudinal slot as the position of the panel support plate with respect to the panel support arm is adjusted; and a compliant bushing positioned between the guide surface and the lower track.

8. The food shield panel support of claim 7 further comprising a cover plate connected to the panel support plate and spaced away from the panel support plate to receive a panel between the panel support plate and the cover plate.

9. A food shield comprising:

a panel support arm;

a panel support plate defining a longitudinal slot;

a tensioning apparatus extending through the slot and connecting the panel support plate to the panel support arm, wherein the tensioning apparatus may be operated to permit the position of the panel support plate with respect to the panel support arm to be adjusted to any one of an infinite number of positions along the length of the slot, and wherein the tensioning apparatus may be further operated to secure the position of the panel support plate at any one of the infinite number of positions along the length of the slot; wherein the tensioning apparatus comprises:

a flange received in the longitudinal slot;

a clamping post connected to the flange and extending through the slot to the panel support arm; and a clamping mechanism connected to the clamping post; and a panel attached to the panel support plate.

10. The food shield of claim 9 wherein the clamping mechanism comprises a cam lever that can be operated without the use of tools.

11. The food shield of claim 9 wherein the support plate defines an upper track above the slot, and wherein the flange is received within the upper track.

12. The food shield of claim 11 wherein the flange comprises opposing substantially linear longitudinal edges that mate with the upper track to limit rotation of the flange and the panel support plate as the position of the panel support plate with respect to the panel support arm is adjusted.

13. The food shield of claim 11 wherein an underside surface of the flange is treated to increase friction between the flange and the upper track, when the tensioning apparatus is operated to secure the position of the panel support plate.

14. The food shield of claim 9 further comprising a cover plate connected to the panel support plate and spaced away from the panel support plate to receive the panel between the panel support plate and the cover plate.

15. A food shield comprising:

a panel support arm;

a panel support plate defining a longitudinal slot;

a tensioning apparatus extending through the slot and connecting the panel support plate to the panel support arm, wherein the tensioning apparatus may be operated to permit the position of the panel support plate with respect to the panel support arm to be adjusted to any one of an infinite number of positions along the length of the slot, and wherein the tensioning apparatus may be further operated to secure the position of the panel support plate at any one of the infinite number of positions along the length of the slot;

a guide surface on the panel support arm;

a lower track defined on the panel support plate, wherein correspondence between the guide surface and the lower track limits rotation of the panel support plate away from a line defined by the longitudinal slot as the position of the panel support plate with respect to the panel support arm is adjusted;

a panel attached to the panel support plate; and a compliant bushing positioned between the guide surface and the lower track.

16. The food shield panel support of claim 15 further comprising a cover plate connected to the panel support plate and spaced away from the panel support plate to receive the panel between the panel support plate and the cover plate.

* * * * *